US008123372B1

(12) United States Patent
Ball et al.

(10) Patent No.: US 8,123,372 B1
(45) **Date of Patent: *Feb. 28, 2012**

(54) UNDERWATER LIGHTING SYSTEM

(76) Inventors: Bradley A. Ball, Tampa, FL (US); Kevin P. Ahearn, Sarasota, FL (US)

( * ) Notice: Subject to any disclaimer, the term of this patent is extended or adjusted under 35 U.S.C. 154(b) by 228 days.

This patent is subject to a terminal disclaimer.

(21) Appl. No.: 12/586,346

(22) Filed: Sep. 21, 2009

Related U.S. Application Data

(63) Continuation-in-part of application No. 11/895,809, filed on Aug. 28, 2007, now Pat. No. 7,591,564.

(51) Int. Cl.
*F21V 33/00* (2006.01)

(52) U.S. Cl. ..... 362/101; 362/267

(58) Field of Classification Search ..... 362/101, 362/154, 203, 231, 267; 285/192, 206, 208
See application file for complete search history.

(56) References Cited

U.S. PATENT DOCUMENTS 3,801,022 A * 4/1974 Cassey ..... 362/257
3,949,213 A * 4/1976 Paitchell ..... 362/101
4,524,408 A * 6/1985 Minera ..... 362/163
4,661,893 A * 4/1987 Robinson et al. ..... 362/267
5,349,505 A * 9/1994 Poppenheimer ..... 362/101
5,842,771 A * 12/1998 Thrasher et al. ..... 362/101
6,220,718 B1 * 4/2001 Burgess ..... 362/101
6,315,424 B1 * 11/2001 Hui ..... 362/22
7,261,443 B1 * 8/2007 Hayes, Jr. ..... 362/385
2002/0178641 A1 * 12/2002 Kent ..... 43/17.5
2005/0024876 A1 * 2/2005 Oppenheimer et al. ..... 362/267
2005/0168970 A1 * 8/2005 Mateescu et al. ..... 362/101
2005/0174774 A1 * 8/2005 Lunt ..... 362/267

* cited by examiner

*Primary Examiner* — Julie Shallenberger

(57) ABSTRACT

A housing has an open top, a closed bottom and a cylindrical side wall forming a chamber interiorly. The housing includes an annular lower flange extending outwardly from the top. A steel disk within the housing provides self-righting weighting. A lens is in an upwardly extending hemispherical configuration. The lens has an annular upper flange in mating contact with the lower flange. A socket assembly including a base is within the chamber. The base has projections terminating in spaced light sockets. A reflector in a downwardly extending semicircular configuration is within the chamber. A bulb has opposed ends. The opposed ends are removably received within the light sockets. Electrical components include a control station and weighted wires. The wires have upper ends coupled to the control station and lower ends coupled to the light sockets.

9 Claims, 6 Drawing Sheets

FIG 1
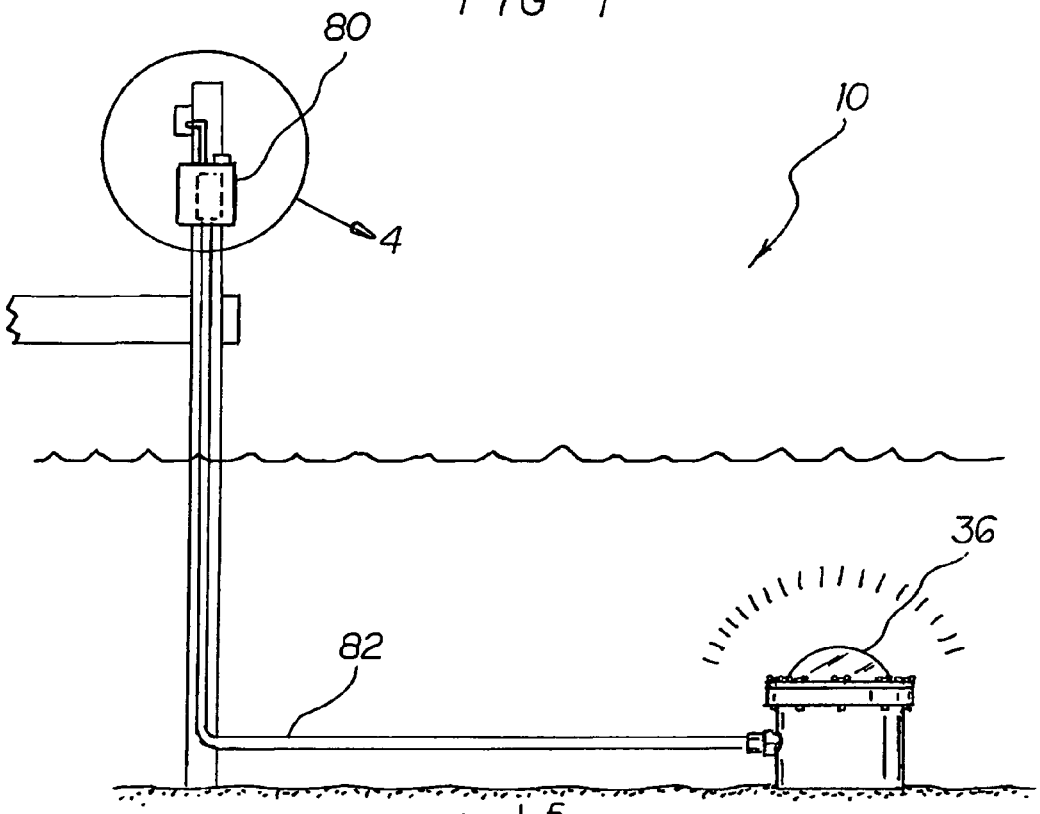
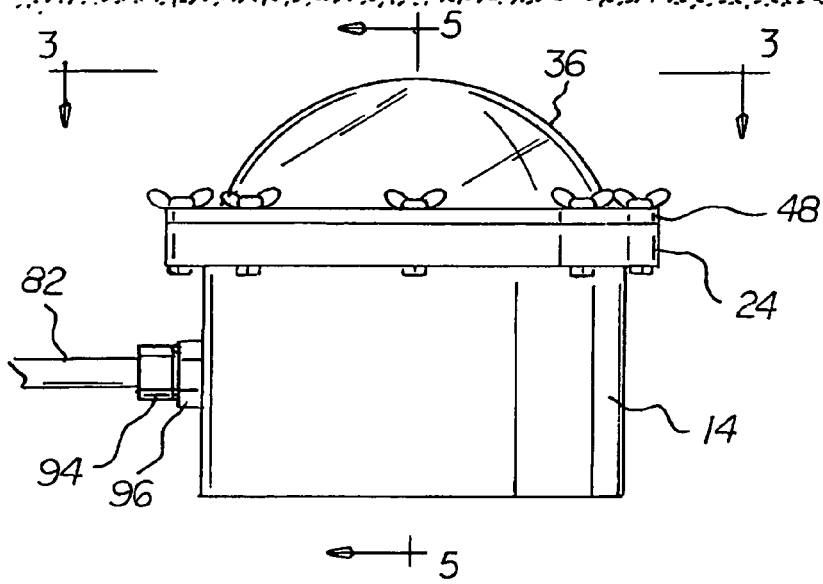
FIG 2

FIG 3
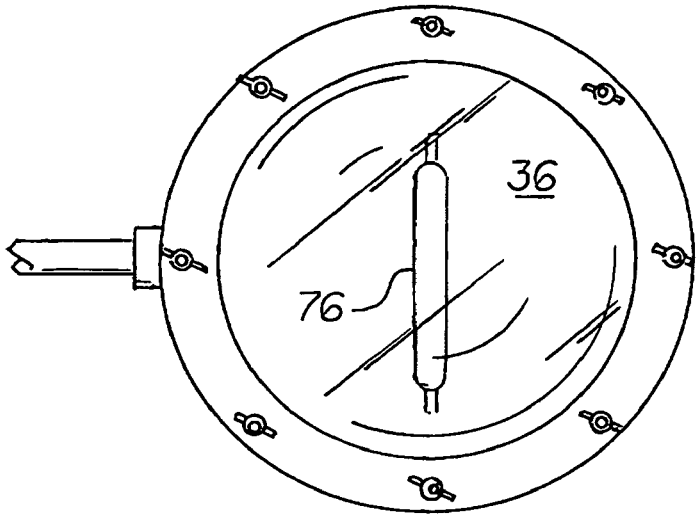
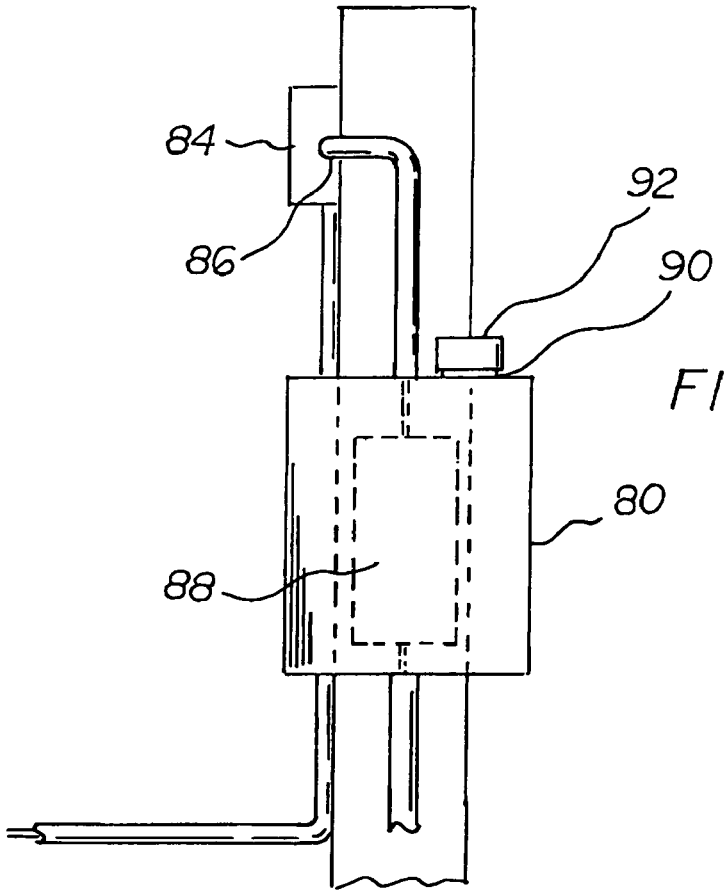
FIG 4

FIG 5
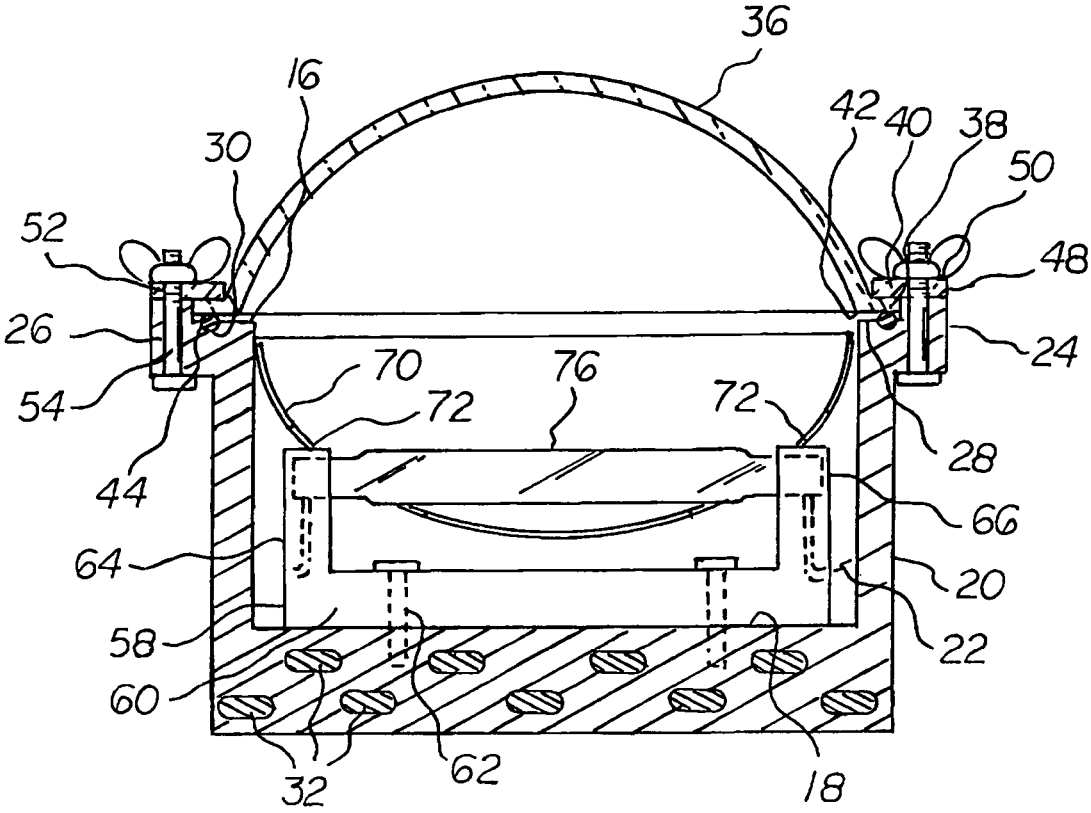
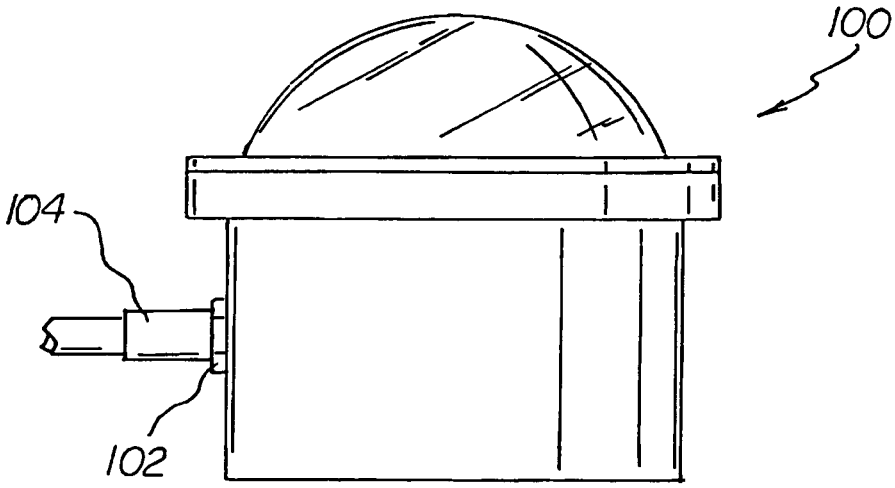
FIG 6

FIG 7
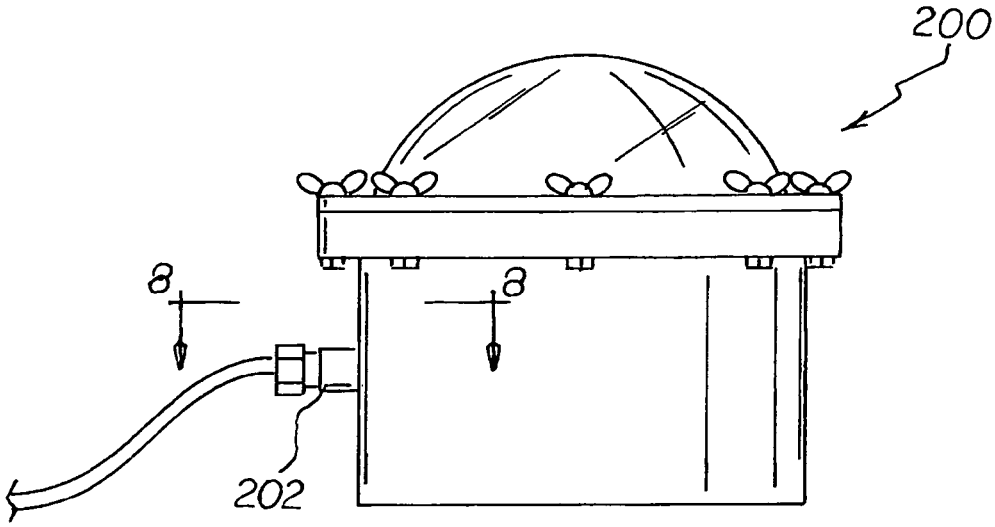
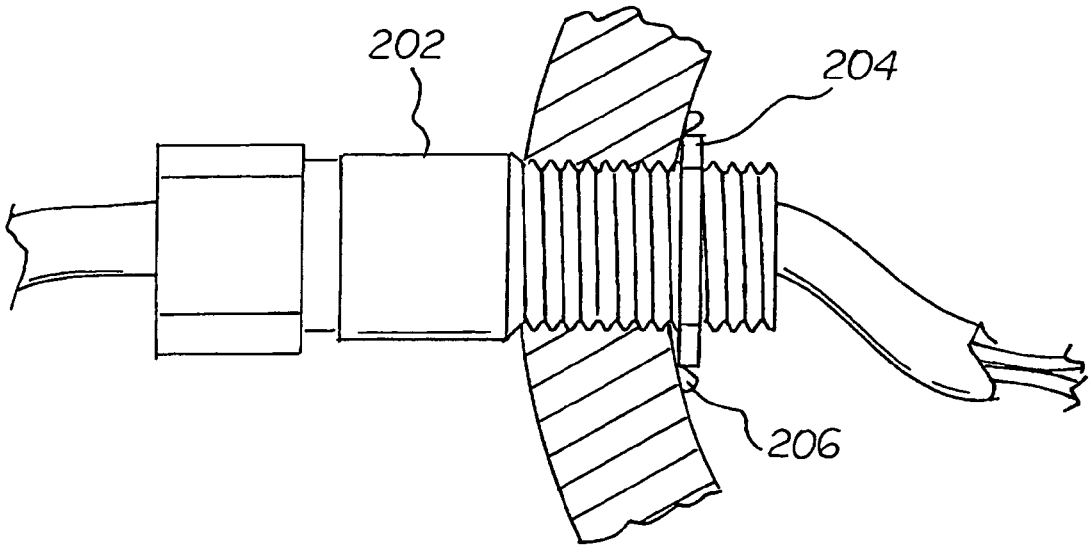
FIG 8

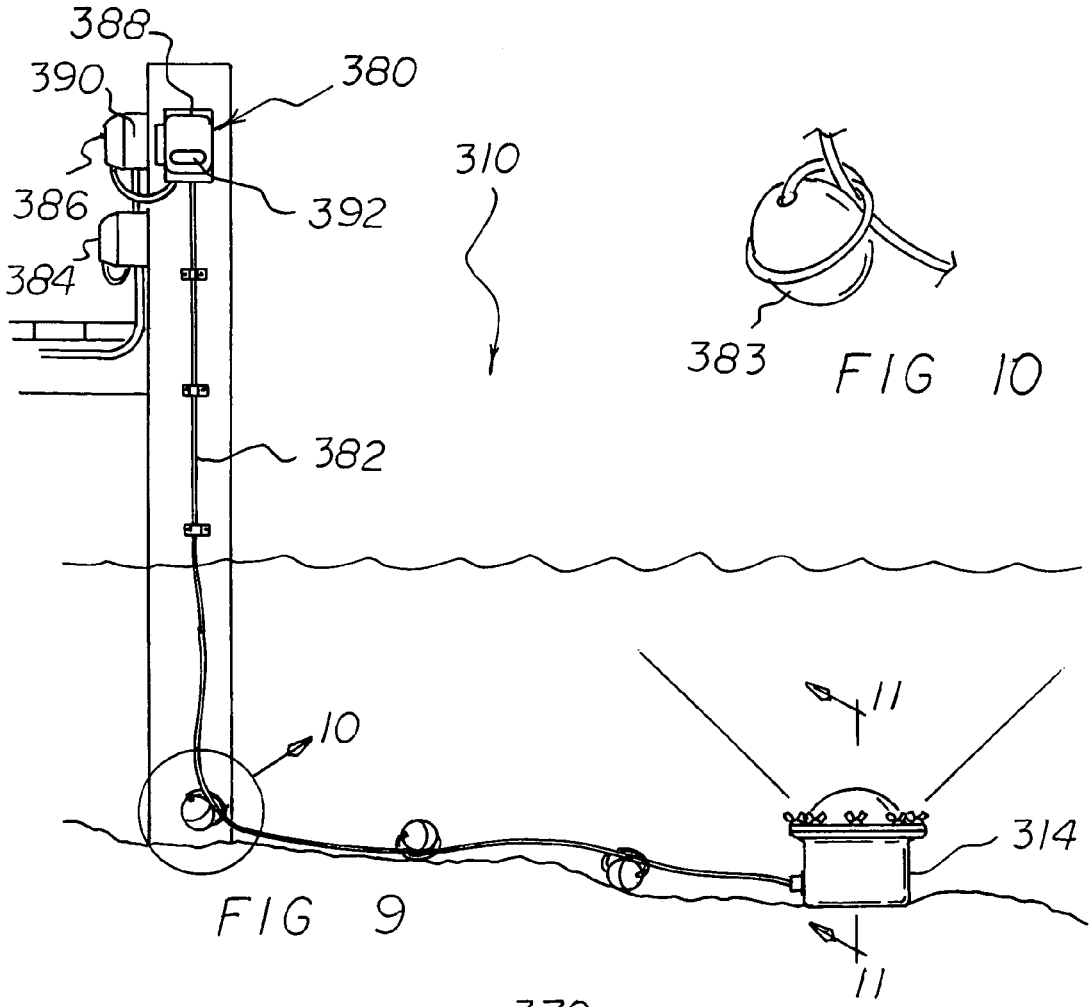
FIG 9
FIG 10
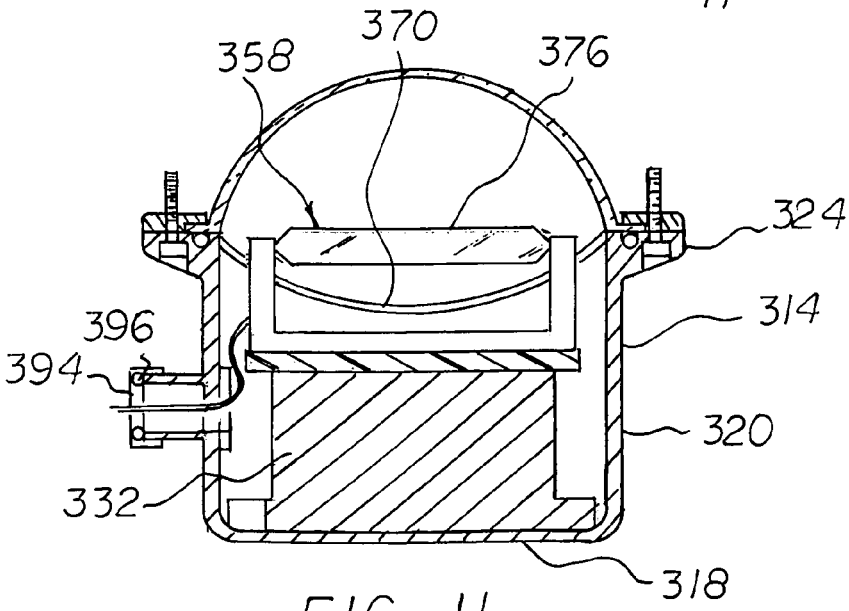
FIG 11

UNDERWATER LIGHTING SYSTEM

RELATED APPLICATION

The present application is a continuation-in-part of application Ser. No. 11/895,809 filed Aug. 28, 2007 now U.S. Pat. No. 7,591,564, the subject matter of which is incorporated by reference herein.

BACKGROUND OF THE INVENTION

1. Field of the Invention

The present invention relates to an underwater lighting system and more particularly pertains to illuminating a large body of water in a safe, convenient and economical manner.

2. Description of the Prior Art

The use of lighting systems of known designs and configurations is known in the prior art. More specifically, lighting systems of known designs and configurations previously devised and utilized for the purpose of providing illumination through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,031,544 issued Jun. 21, 1977 to Lapetina relates to a Sonar/Television System for use in Underwater Exploration. U.S. Pat. No. 6,315,429 issued Nov. 13, 2001 to Grandolfo relates to an Underwater Lighting System. U.S. Pat. No. 6,633,110 issued Oct. 14, 2003 to McGuire relates to an Underwater Lamp. Lastly, U.S. Pat. No. 7,008,081 issued Mar. 7, 2006 to Lunt relates to an Underwater Light.

While these devices fulfill their respective, particular objectives and requirements, the aforementioned patents do not describe an underwater lighting system that allows for illuminating a large body of water in a safe, convenient and economical manner.

In this respect, the underwater lighting system according to the present invention substantially departs from the conventional concepts and designs of the prior art, and in doing so provides an apparatus primarily developed for the purpose of illuminating a large body of water in a safe, convenient and economical manner.

Therefore, it can be appreciated that there exists a continuing need for a new and improved underwater lighting system which can be used for illuminating a large body of water in a safe, convenient and economical manner. In this regard, the present invention substantially fulfills this need.

SUMMARY OF THE INVENTION

In view of the foregoing disadvantages inherent in the known types of lighting systems of known designs and configurations now present in the prior art, the present invention provides an improved underwater lighting system. As such, the general purpose of the present invention, which will be described subsequently in greater detail, is to provide a new and improved underwater lighting system and method which has all the advantages of the prior art and none of the disadvantages.

To attain this, the present invention essentially comprises an underwater lighting system. First provided is a housing. The housing has a circular open top. The housing has a circular closed bottom. The housing has a cylindrical side wall. The side wall is provided between the top and the bottom. The housing forms a chamber. The chamber is provided interiorly.

The housing includes an annular lower flange. The lower flange extends radially outwardly from the top. The lower flange has eight holes. The holes are equally spaced around the circumference of the lower flange. The lower flange has an upper face. The upper face terminates interiorly at the chamber and externally at the lower flange. The upper face has a semicircular recess. The recess is provided around the entire upper face. The housing is molded of an elastomeric material. The elastomeric material is selected from the class of elastomeric materials. The class of elastomeric materials includes plastic and rubber, natural and synthetic, and blends thereof. The bottom of the housing has a thickness equal to the thickness of the side wall. The housing has a steel disk. The steel disk is located in the chamber. In this manner the weight of the housing is increased to 14.5 pounds for ballast purposes when thrown into water and submerged.

A lens is provided. The lens is in an upwardly extending hemispherical configuration. The lens has an annular upper flange. The lens has an upper face. The lens has a lower face. The lower face of the lens is in mating contact with the upper face of the lower flange. An O-ring 44 is provided. The O-ring is received within the recess between the faces. The lens is fabricated of a transparent material. The transparent material is selected from the class of transparent materials. The class of transparent materials includes glass and plastic.

Provided next is a pressure ring. The pressure ring is in an annular configuration. The pressure ring has an upper face. The pressure ring has a lower face. The lower face of the pressure ring is in contact with the lower flange of the housing. The upper flange of the lens has eight holes. The holes are equally spaced around the circumference of the pressure ring. The holes are aligned with the holes of the lower flange. Bolts are provided. The bolts extend through the holes of the lower flange and pressure ring. Wing nuts are provided. The wing nuts provide for coupling.

A socket assembly is provided. The socket assembly is provided within the chamber. The socket assembly includes a polycarbonate base. The base is positioned on the bottom. Bolts are provided. The bolts secure the base. The socket assembly also includes projections. The projections terminate in spaced light sockets. The projections terminate at an elevation midway between the bottom and the top of the housing.

A reflector is provided next. The reflector is in a downwardly extending semicircular configuration within the chamber. The reflector is coupled to the socket assembly. The reflector has spaced apertures. In this manner passage of the light sockets is allowed.

Further provided is an elongated halogen bulb. The bulb has opposed ends. The bulb is removably received within the light sockets of the socket assembly. The bulb is adapted to be replaced without contacting the reflector.

Provided last are electrical components. The electrical components include a control station. The electrical components include wires. The wires have upper ends. The upper ends of the wires are coupled to the control station. The wires have lower ends. The lower ends of the wires are coupled to the light sockets. The wires are coated with polyvinyl coating to a thickness of 0.410 inches for added weight. A lead ring is provided around the coating for added weight. The control station has an AC power adapter, a switch, a ballast, a timer and a light sensor. The lower end has a compression washer and an O-ring. In this manner the wire may be coupled to the housing.

The preferred source of illumination is a lamp which emits UV-A in the range of ultra violet light between 320 and 400 nanometers and designed to peak at 360 nanometers.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved underwater lighting system which has all of the advantages of the prior art lighting systems of known designs and configurations and none of the disadvantages.

It is another object of the present invention to provide a new and improved underwater lighting system which may be easily and efficiently manufactured and marketed.

It is further object of the present invention to provide a new and improved underwater lighting system which is of durable and reliable constructions.

An even further object of the present invention is to provide a new and improved underwater lighting system which is susceptible of a low cost of manufacture with regard to both materials and labor, and which accordingly is then susceptible of low prices of sale to the consuming public, thereby making such underwater lighting system economically available to the buying public.

Even still another object of the present invention is to provide an underwater lighting system for illuminating a large body of water in a safe, convenient and economical manner.

Lastly, it is an object of the present invention to provide a new and improved underwater lighting system. A housing has an open top and closed bottom. The housing has a cylindrical side wall. In this manner a chamber is formed interiorly. The housing includes an annular lower flange. The lower flange extends outwardly from the top. A steel disk within the housing is provided for self-righting weighting purposes. A lens is in an upwardly extending hemispherical configuration. The lens has an annular upper flange. The upper flange is in mating contact with the lower flange. A socket assembly including a base is provided within the chamber. The base has projections. The projections terminate in spaced light sockets. A reflector is in a downwardly extending semicircular configuration within the chamber. A bulb has opposed ends. The opposed ends are removably received within the light sockets. Electrical components include a control station and weighted wires. The weighted wires have upper ends coupled to the control station. The weighted wires have lower ends coupled to the light sockets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated not only the primary and preferred embodiment of the present invention but also an alternate embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of an underwater lamp system constructed in accordance with the principles of the present invention.

FIG. 2 is an enlarged front elevational view of the underwater lamp system in FIG. 1.

FIG. 3 is a plan view of the system taken along line 3-3 of FIG. 2.

FIG. 4 is an enlarged illustration of the components in Circle 4 in FIG. 1.

FIG. 5 is a cross sectional view of the system taken along line 5-5 of FIG. 2.

FIG. 6 is an enlarged front elevational view of an underwater lamp system constructed in accordance with an alternate embodiment of the present invention.

FIG. 7 is an enlarged front elevational view of an underwater lamp system constructed in accordance with another alternate embodiment of the present invention.

FIG. 8 is a cross sectional view of the system taken along line 8-8 of FIG. 7.

FIG. 9 is a front elevational view similar to FIG. 1 but illustrating an alternate embodiment of the invention.

FIG. 10 is a perspective illustration of one of the rings.

FIG. 11 is a cross sectional view of the housing taken at line 11-11 of FIG. 9.

The same reference numerals refer to the same parts throughout the various Figures including the primary and preferred embodiment of the invention but also the alternate embodiment of the invention.

DESCRIPTION OF THE PREFERRED EMBODIMENT

Figure 12:
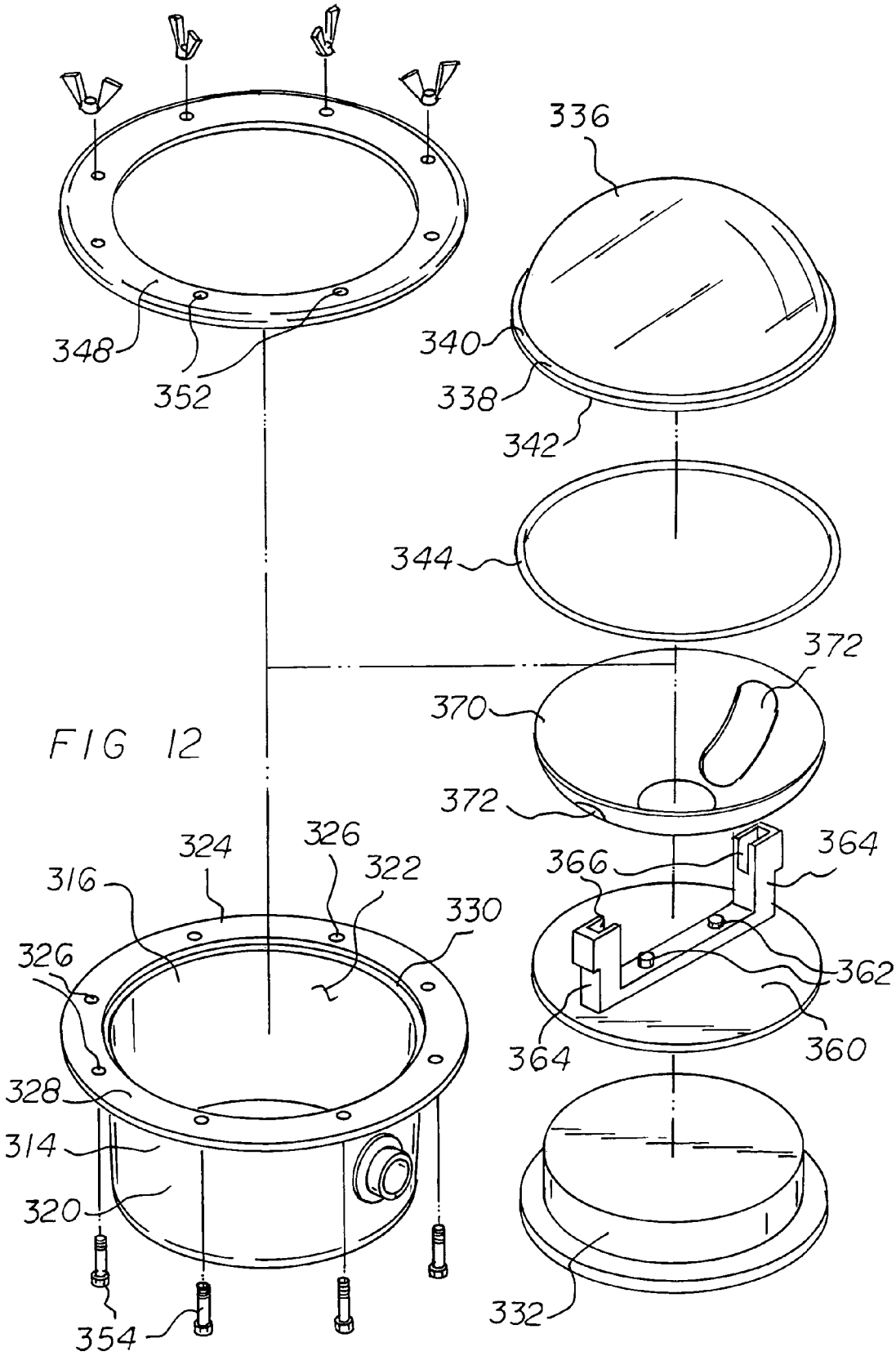
FIG. 12 is an exploded perspective illustration of the housing shown in FIGS. 9 and 11.

With reference now to the drawings, and in particular to FIG. 1 thereof, the preferred embodiment of the new and improved underwater lighting system embodying the principles and concepts of the present invention and generally designated by the reference numeral 10 will be described.

The present invention, the underwater lighting system 10 is comprised of a plurality of components. Such components in their broadest context include a housing, a lens, a socket assembly, a reflector, a bulb and electrical components. Such components are individually configured and correlated with respect to each other so as to attain the desired objective.

First provided is a housing 14. The housing has a circular open top 16. The housing has a circular closed bottom 18. The housing has a cylindrical side wall 20. The side wall is provided between the top and the bottom. The housing forms a chamber 22. The chamber is provided interiorly. The housing includes an annular lower flange 24. The lower flange extends radially outwardly from the top. The lower flange has eight holes 26. The holes are equally spaced around the circumference of the lower flange. The lower flange has an upper face 28. The upper face terminates interiorly at the chamber and externally at the lower flange. The upper face has a semicircular recess 30. The recess is provided around the entire upper face. The housing is molded of an elastomeric material. The elastomeric material is selected from the class of elastomeric materials. The class of elastomeric materials includes plastic and rubber, natural and synthetic, and blends thereof. The bottom of the housing has a thickness more than twice the thickness of the side wall. The housing has lead weights 32. The weights are integrally formed into the bottom of the housing. In this manner the weight of the housing is increased for ballast purposes when submerged.

A lens 36 is provided. The lens is in an upwardly extending hemispherical configuration. The lens has an annular upper flange 38. The lens has an upper face 40. The lens has a lower face 42. The lower face of the lens is in mating contact with the upper face of the lower flange. An O-ring 44 is provided. The O-ring is received within the recess between the faces. The lens is fabricated of a transparent material. The transparent material is selected from the class of transparent materials. The class of transparent materials includes glass and plastic.

Provided next is a pressure ring 48. The pressure ring is in an annular configuration. The pressure ring has an upper face 50. The pressure ring has a lower face. The lower face of the pressure ring is in contact with the lower flange of the housing. The upper flange of the lens has eight holes 52. The holes are equally spaced around the circumference of the pressure ring. The holes are aligned with the holes of the lower flange. Bolts 54 are provided. The bolts extend through the holes of the lower flange and pressure ring. Wing nuts are provided. The wing nuts provide for coupling.

A socket assembly 58 is provided. The socket assembly is provided within the chamber. The socket assembly includes a base 60. The base is positioned on the bottom. Bolts 62 are provided. The bolts secure the base. The socket assembly also includes projections 64. The projections terminate in spaced light sockets 66. The projections terminate at an elevation midway between the bottom and the top of the housing.

A reflector 70 is provided next. The reflector is in a downwardly extending semicircular configuration within the chamber. The reflector is coupled to the socket assembly. The reflector has spaced apertures 72. In this manner passage of the light sockets is allowed.

Further provided is an elongated metal halide bulb 76. The bulb has opposed ends. The bulb is removably received within the light sockets of the socket assembly. The bulb is adapted to be replaced without contacting the reflector.

Provided last are electrical components. The electrical components include a control station 80. The electrical components include wires 82. The wires have upper ends. The upper ends of the wires are coupled to the control station. The wires have lower ends. The lower ends of the wires are coupled to the light sockets. The control station has an AC power adapter 84, a switch 86, a ballast 88, a timer 90 and a light sensor 92. The lower end has a compression washer 94 and an O-ring 96. In this manner the wire may be coupled to the housing.

Reference is now made to the alternate embodiment of the invention illustrated in FIG. 6. The lower end of the wires includes a nut 102. The nut is provided adjacent to the housing. A PVC sleeve 104 is provided. The PVC sleeve is provided adjacent to the nut. An adhesive is provided. The adhesive couples the sleeve to the wires to the housing. The remaining components of the system are the same as in the primary embodiment described above.

FIG. 7 is an enlarged front elevational view of an underwater lamp system 200 constructed in accordance with another alternate embodiment of the present invention while FIG. 8 is a cross sectional view of the system taken along line 8-8 of FIG. 7. Such system includes a rigid male member 202 extending through an aperture in the housing. Such aperture is shown as threaded but is unthreaded in another alternate embodiment. The end of the male member inside of the housing is threaded and receives a threaded female member 204. A marine adhesive sealant 206 with limited flexibility is located between the interior surface of the housing and the female member. The preferred material for the marine adhesive sealant is 3M 5200, a marine adhesive sealant. 3M 5200 is a trademark of Minnesota Mining and Manufacturing, a corporation of Delaware, having a place of business in Minneapolis, Minn. The female member and the forward portion of the male member extending through the housing are preferably fabricated of brass. The rearward portion of the male member is a cable gland and is located exterior of the housing and extends into the forward portion. The cable gland is preferably fabricated of polyvinyl chloride. Electrical wires in a plastic conduit extend through the male and female members to bring electric power to the bulb. The remaining components of the system are the same as in the primary embodiment described above.

The preferred source of illumination is a lamp which emits UV-A in the range of ultra violet light between 320 and 400 nanometers and designed to peak at 360 nanometers. Such light has been shown to stimulate retinal reactivity in non-mammalian organs. UV-A is the light spectrum region that causes pigment to darken in human and other mammalian cells but is invisible to species in that group. Primarily fish, insects and some invertebrates are able to visibly detect UV-A in nature, but some birds may have the ability, as well.

In an alternate embodiment of the invention, as shown in FIGS. 9, 10, 11 and 12, the underwater lighting system 310 has a housing 314. The housing has a circular open top 316. The housing has a circular closed bottom 318. The housing has a cylindrical side wall 320. The side wall is provided between the top and the bottom. The housing forms a chamber 322. The chamber is provided interiorly. The housing includes an annular lower flange 324. The lower flange extends radially outwardly from the top. The lower flange has eight holes 326. The holes are equally spaced around the circumference of the lower flange. The lower flange has an upper face 328. The upper face terminates interiorly at the chamber and externally at the lower flange. The upper face has a semicircular recess 330. The recess is provided around the entire upper face. The housing is molded of an elastomeric material. The elastomeric material is selected from the class of elastomeric materials. The class of elastomeric materials includes plastic and rubber, natural and synthetic, and blends thereof. The bottom of the housing has a thickness equal to the thickness of the side wall. The housing has a steel disk 332 weighing 10.5 pounds. The steel disk is located in the chamber. In this manner the weight of the housing is increased to 14.5 pounds for ballast purposes when thrown into water and submerged.

A lens 336 is provided. The lens is in an upwardly extending hemispherical configuration. The lens has an annular upper flange 338. The lens has an upper face 340. The lens has a lower face 342. The lower face of the lens is in mating contact with the upper face of the lower flange. An O-ring 344 is provided. The O-ring is received within the recess between the faces. The lens is fabricated of a transparent material. The transparent material is selected from the class of transparent materials. The class of transparent materials includes glass and plastic.

Provided next is a pressure ring 348. The pressure ring is in an annular configuration. The pressure ring has an upper face. The pressure ring has a lower face. The lower face of the pressure ring is in contact with the lower flange of the housing. The upper flange of the lens has eight holes 352. The holes are equally spaced around the circumference of the pressure ring. The holes are aligned with the holes of the lower flange. Bolts 354 are provided. The bolts extend through the holes of the lower flange and pressure ring. Wing nuts are provided. The wing nuts provide for coupling.

A socket assembly 358 is provided. The socket assembly is provided within the chamber. The socket assembly includes a polycarbonate base 360. The base is positioned on the bottom. Bolts 362 are provided. The bolts secure the base. The socket assembly also includes projections 364. The projections terminate in spaced light sockets 366. The projections terminate at an elevation midway between the bottom and the top of the housing.

A reflector 370 is provided next. The reflector is in a downwardly extending semicircular configuration within the chamber. The reflector is coupled to the socket assembly. The reflector has spaced apertures 372. In this manner passage of the light sockets is allowed.

Further provided is an elongated halogen bulb 376. The bulb has opposed ends. The bulb is removably received within the light sockets of the socket assembly. The bulb is adapted to be replaced without contacting the reflector.

Provided last are electrical components 380. The electrical components include a control station. The electrical components include wires 382. The wires have upper ends. The upper ends of the wires are coupled to the control station. The wires have lower ends. The lower ends of the wires are coupled to the light sockets. The wires are coated with polyvinyl coating to a thickness of 0.410 inches for added weight. A lead ring 383 is provided around the coating for added weight. The control station has an AC power adapter 384, a switch 386, a ballast 388, a timer 390 and a light sensor 392. The lower end has a compression washer 394 and an O-ring 396. In this manner the wire may be coupled to the housing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An underwater lighting system comprising:

a housing with an open top and closed bottom and with a cylindrical side wall forming a chamber interiorly, the housing including an annular lower flange extending outwardly from the top, a steel disk within the housing for self-righting weighting purposes;

a lens in an upwardly extending hemispherical configuration having an annular upper flange in mating contact with the lower flange;

a socket assembly within the chamber including a base with projections terminating in spaced light sockets;

a reflector in a downwardly extending semicircular configuration within the chamber;

a bulb with opposed ends removably received within the light sockets; and electrical components including a control station and weighted wires with upper ends coupled to the control station, the wires having lower ends coupled to the light sockets.

2. The system as set forth in claim 1 wherein the bulb is at an elevation midway between the top and the bottom of the housing.

3. The system as set forth in claim 1 wherein the bulb is a halogen bulb.

4. The system as set forth in claim 1 wherein the control station has an AC power adapter, a switch, a ballast, a timer and a light sensor.

5. The system as set forth in claim 1 wherein the lower end of the wires has a compression washer and an O-ring for coupling the wire to the housing.

6. The system as set forth in claim 1 wherein the lower end of the wires includes a nut adjacent to the housing with a PVC sleeve adjacent to the nut and with an adhesive for coupling the sleeve to the wires to the housing.

7. The system as set forth in claim 1 wherein the lower end of the wires includes a male member extending through an aperture in the housing with a female member threadedly received on an end of the male member within the housing and a marine adhesive sealant with limited flexibility in contact with the male member between the housing and the female member.

8. The system as set forth in claim 1 wherein the lamp provides a source of illumination which emits UV-A in the range of ultra violet light between 320 and 400 nanometers and designed to peak at 360 nanometers.

9. An underwater lighting system for illuminating a large body of water in a safe, convenient and economical manner comprising, in combination:

a housing with a circular open top and a circular closed bottom with a cylindrical side wall between the top and the bottom, the housing forming a chamber interiorly and including an annular lower flange extending radially outwardly from the top with eight holes equally spaced around the circumference of the lower flange, the lower flange having an upper face terminating interiorly at the chamber and externally at the lower flange with a semicircular recess around the entire upper face, the housing being molded of an elastomeric material selected from the class of elastomeric materials including plastic and rubber, natural and synthetic, and blends thereof, the bottom of the housing having a thickness equal to the thickness of the side wall, a steel disk located in the chamber to increase the weight of the housing to 14.5 pounds for ballast and self-righting purposes when thrown into the water and submerged;

a lens in an upwardly extending hemispherical configuration having an annular upper flange with an upper face and a lower face in mating contact with the upper face of the lower flange with an O-ring received within the recess between the faces, the lens being fabricated of a transparent material selected from the class of transparent materials including glass and plastic;

a pressure ring in an annular configuration with an upper face and a lower face in contact with the lower flange of the housing and the upper flange of the lens with eight holes equally spaced around the circumference of the pressure ring aligned with the holes of the lower flange, bolts extending through the holes of the lower flange and pressure ring with wing nuts for coupling purposes;

a socket assembly within the chamber including a polycarbonate base positioned on the bottom and secured with bolts and also including projections terminating in spaced light sockets at an elevation midway between the bottom and the top of the housing;

a reflector in a downwardly extending semicircular configuration within the chamber, the reflector coupled to the socket assembly with spaced apertures for the passage of the light sockets;

an elongated halogen bulb with opposed ends removably received within the light sockets of the socket assembly, the bulb adapted to be replaced without contacting the reflector; and electrical components including a control station and weighted wires with upper ends coupled to the control station and with lower ends coupled to the light sockets, the wires being coated with a polyvinyl coating to a thickness of 0.410 inches for added weight, a lead ring around the coating for added weight, the control station having an AC power adapter, a switch, a ballast, a timer and a light sensor, the lower end having a compression washer and an O-ring for coupling the wire to the housing, the lamp providing a source of illumination which emits UV-A in the range of ultra violet light between 320 and 400 nanometers and designed to peak at 360 nanometers.

* * * * *